US007810212B2

(12) United States Patent
Salice

(10) Patent No.: US 7,810,212 B2
(45) Date of Patent: Oct. 12, 2010

(54) FURNITURE HINGE WITH DAMPING DEVICE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 150 days.

(21) Appl. No.: 12/093,361

(22) PCT Filed: May 10, 2007

(86) PCT No.: PCT/EP2007/054520

§ 371 (c)(1),
(2), (4) Date: May 12, 2008

(87) PCT Pub. No.: WO2007/131933

PCT Pub. Date: Nov. 22, 2007

(65) Prior Publication Data

US 2009/0049645 A1 Feb. 26, 2009

(30) Foreign Application Priority Data

May 11, 2006 (IT) ..... RM060081 U

(51) Int. Cl.
*E05F 1/08* (2006.01)

(52) U.S. Cl. ..... 16/286; 16/54

(58) Field of Classification Search ..... 16/286–288, 16/50, 54, 56, 82, 294, DIG. 21; 188/268, 188/276, 290, 291, 296, 322.5
See application file for complete search history.

(56) References Cited

U.S. PATENT DOCUMENTS

| | | | | |
|---|---|---|---|---|
| 3,362,510 | A * | 1/1968 | Nash | 188/290 |
| 4,449,269 | A * | 5/1984 | Sundermeier et al. | 16/50 |
| 4,550,470 | A * | 11/1985 | Omata | 16/85 |
| 6,298,960 | B1 * | 10/2001 | Derr | 188/290 |
| 7,003,851 | B2 * | 2/2006 | Salice | 16/285 |
| 7,127,778 | B2 * | 10/2006 | Salice | 16/354 |
| 2006/0026792 | A1 * | 2/2006 | Brustle et al. | 16/54 |
| 2007/0136990 | A1 * | 6/2007 | Salice | 16/282 |

FOREIGN PATENT DOCUMENTS

DE 10211294 9/2003

* cited by examiner

*Primary Examiner*—Chuck Y. Mah
(74) *Attorney, Agent, or Firm*—Gifford, Krass Sprinkle, Anderson & Citkowski, p

(57) ABSTRACT

Furniture hinge with damping device which is insertable into the box of the hinge and fixable therein before the box is assembled with the other components of the hinge. In this way the damping device is protected against external actions, such as impact or pressure that can damage or affect the functioning of the device, by the same box made of steel or of another rigid material.

16 Claims, 5 Drawing Sheets

FURNITURE HINGE WITH DAMPING DEVICE

CROSS REFERENCE TO RELATED APPLICATIONS

This application is the U.S. national phase of PCT/EP2007/054520 filed May 10, 2007, which claims priority of Italian Patent Application No. RM2006U000081 filed May 11, 2006.

FIELD OF THE INVENTION

The present invention relates to a furniture hinge, in particular a hinge with spring for doors, or in general for furniture parts suitable to be brought into motion, provided with a damping device which acts during opening and/or closing of the doors.

STATE OF THE ART

Furniture provided with doors or wings to close compartments and which open by pivoting about a horizontal or vertical axis uses various types of hinge. A type which is very widely used today is one in which the hinges to support the doors in the closed position are not visible from the outside of the piece of furniture when the door is closed.

Hinges of this type are today commonly used in the furniture industry as they have a series of advantages, which have determined their extensive use on the market. Some embodiments of known hinges are provided with springs of various types to produce a return force during closing or a pushing force during opening of the doors to which they are fitted. This allows very precise closing or opening of the doors.

Nonetheless, damping and/or braking devices of the door movement caused by the elastic reaction of the spring are desirable in these hinges. The object of these devices is above all to prevent noise caused during closing operations by doors banging shut against the body of the piece of furniture.

Some hinges of the type known in the prior art are provided with a damping device wherein a rectangular slider, moved by the cam fitted to the rocker of the hinge, transmits the motion to a disc that is braked by the high viscosity grease. The known device is fitted from the outside beneath the box of the hinge and the cam of the rocker engages with the slider passing through an opening provided in the base of the same box.

Disadvantageously this arrangement makes the device subject to possible accidental or undesirable external actions, such as impact during production or during packaging of the hinges, or pressure due to the insertion of the hinge box into the milled holes of the doors when assembling the hinges on the furniture. This impact or pressure can damage or in any case affect the functioning of the damping device or decelerator.

Another drawback with this type of device can, moreover, be attributed to the presence of the base of the box between the cam of the rocker and the slider of the device, in that it limits the possibility of fully exploiting the small amount of space that is available to house the decelerator or the possibility of advantageously shaping the relative component elements thereof.

Therefore, there is a need to produce a furniture hinge provided with damping device which is capable of overcoming the aforesaid drawbacks.

SUMMARY OF THE INVENTION

The main object of the present invention is to produce a furniture hinge provided with a damping device that is insertable into the box of the hinge and fixable therein before the box is assembled with the other components of the hinge. In this way the damping device is protected against external actions, such as impact or pressure that can damage or affect the functioning of the device, by the same box made of steel or of another rigid material.

A further object is to produce a hinge having a configuration that allows a more practical use of the space inside said hinge, even making it possible to use decelerators based on systems known in the prior art, such as rotational decelerators or cylinder and piston decelerators.

Therefore, the present invention proposes to resolve the problems discussed above by producing a furniture hinge with damping device having the characteristics of the claim 1.

Advantageously the damping device of the hinge according to the invention can provide the hinge box itself as a component element thereof, or the damping device can consist entirely of elements that are separate from the box, which can be pre-mounted together and then inserted into the box properly provided with suitable means for fixing or blocking said elements. This modularity makes construction and final assembly much easier.

The improved efficiency of the hinge is obtained by increasing the friction surfaces with the viscous medium present in suitable areas of the hinge and/or by allowing regulation of the trend of the angular velocity of at least one circular element, for example a disc, which acts as braking element in contact with the viscous medium.

Finally, a further advantage is that the damping device, thanks to its compactness and being mounted inside the box element, is incorporated inside the thickness of the furniture door and is therefore invisible when the door is opened, also improving the aesthetic appearance.

The dependent claims describe preferred embodiments of the invention.

BRIEF DESCRIPTION OF THE FIGURES

Further characteristics and advantages of the invention will be more apparent in the light of the detailed description of preferred, although non-exclusive, embodiments of a furniture hinge with damping device illustrated, by way of a non-limiting example, with the aid of the accompanying drawings wherein.

DETAILED DESCRIPTION OF PREFERRED EMBODIMENTS OF THE INVENTION

Figure 1:
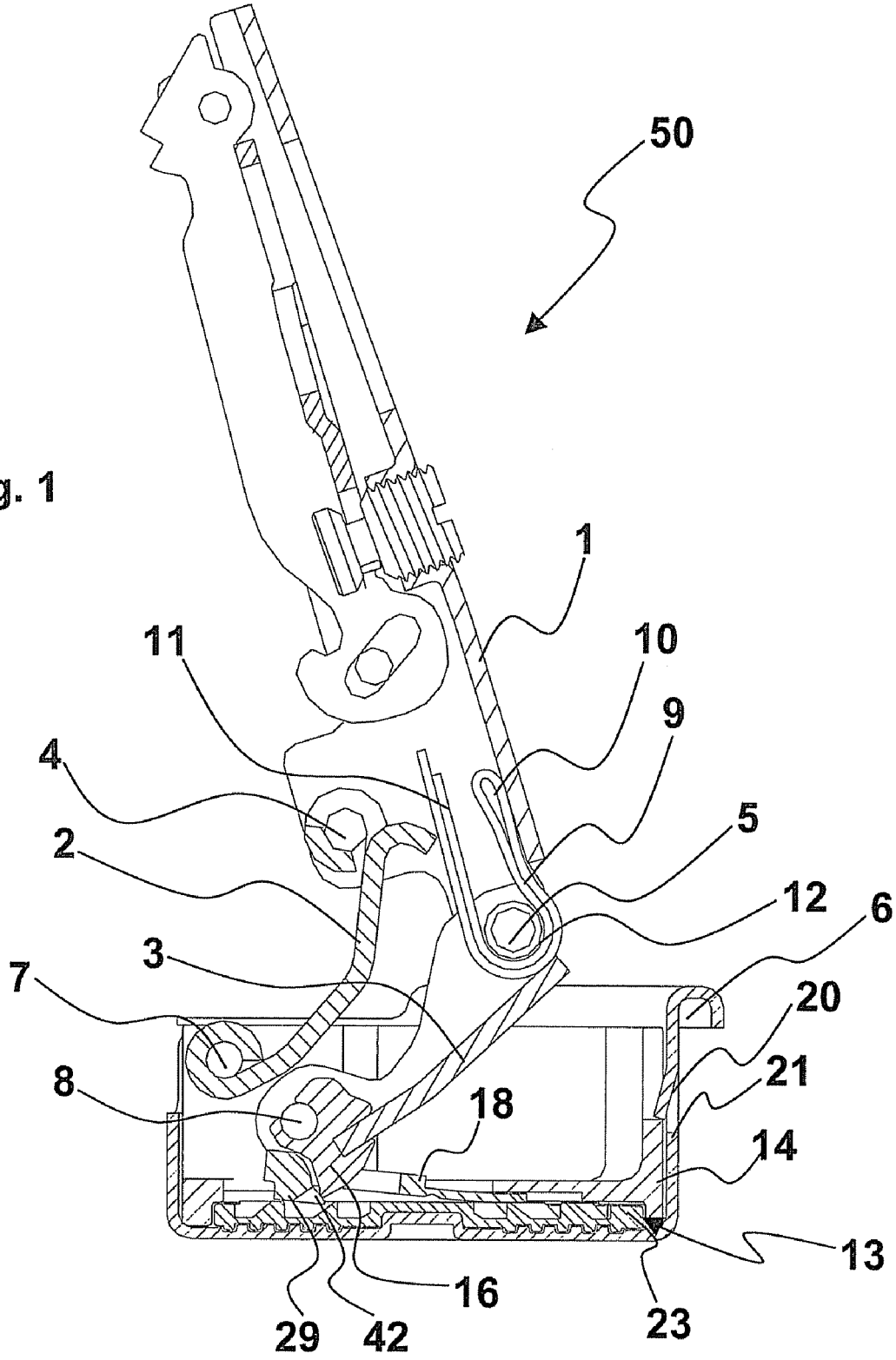
FIG. 1 shows a sectional view of a first embodiment of the hinge of the invention in a half-open position.

With reference to FIG. 1, a hinge is represented, indicated as a whole with the reference 50, comprising a fixed element, or hinge arm 1, which is fixable on a base, or plate, in turn fixed integrally to a bearing wall of a side panel or any suitable element of a piece of furniture.

The hinge is provided with two rockers 2 and 3, with a respective first end thereof pivoting about two respective pins 4, 5 housed in holes in the side walls of the arm 1. The arm 1 is connected to a box element 6, or simply box, fixed in a cavity produced in the inside wall of the door or wing of the piece of furniture, or of any other appropriate pivoting element of the piece of furniture. The two respective second ends of the rockers 2 and 3 are housed in rotation on two other respective pins 7, 8 with axes parallel to the first two pins 4, 5. The four pins 4, 5, 7, 8 form an articulated quadrilateral.

Around the articulation pin 5, connecting the rocker 3 to the arm 1, there is provided an elastic element or spring 9. One of the arms 10 of said elastic element is resting on the hinge arm 1, while the other arm 11 reacts on the rocker 2. Closing of the arms 10, 11 of the elastic element 9 is established so that this element 9 exerts a pushing force on the rocker 2 until the position shown in FIG. 1. Beyond this opening angle of the door, approximately from 15 to 20°, the elastic element 9 has a compression with a negligible application arm, so that the remaining part of the pivoting movement of the door takes place freely without being influenced by the presence of elastic forces.

On the other hand, in the closing phase of the door, the elastic element 9 produces a return force in the closing direction which allows a precise and spontaneous closing of the door in the final angular space, with an amplitude of approximately 15 to 20°.

A bushing 12 can be appropriately interposed between the elastic element 9 and the pin 5. Alternatively, the element 9 can be detached from the pin 5 and be anchored in a known way to the hinge arm 1.

Inside the box element 6 there is mounted advantageously a damping and/or braking device 13 suitable to reduce jerky movements which take place during the opening and/or closing phases of the doors, reducing noise and allowing these phases to take place comfortably and smoothly.

This device 13 comprises a housing formed of a casing or cover 14 and of part of the box element 6. Inside said housing there are advantageously inserted a slider 18 and at least one braking element immersed in a highly viscous medium, such as grease.

The shape of the casing 14 is such as to allow it to be fixed to the box element 6 by means of the same pins 7, 8, about which the second ends of the rockers 2 and 3 respectively pivot. Said pins 7, 8 pass through the holes 70, 71 of the casing 14 and the corresponding holes 80, 81 on the box element 6.

The inside of the casing 14 is provided with a hole or opening 15, which is substantially rectangular or square or of another shape, to allow a connection element, preferably a cam element 6 fixed to the lower end of the rocker 3, pivoting about the pin 8 for articulation with the box element, or integral therewith, to engage with the slider 18, thus controlling said slider in translation in a first or second direction in correspondence with the pivoting direction of the hinge.

A first advantageous embodiment of the hinge according to the invention, illustrated in FIGS. 1 to 6, provides a box element or box 6, made of steel, of a standard size or drawn slightly deeper than the types of box known in the prior art but in such a way as not to make it difficult to insert said box in the milled holes on the doors of the furniture.

Said box 6 is provided with at least one flange 90 for fixing to the inside wall of the door or wing of the element of piece of furniture.

Figure 6:
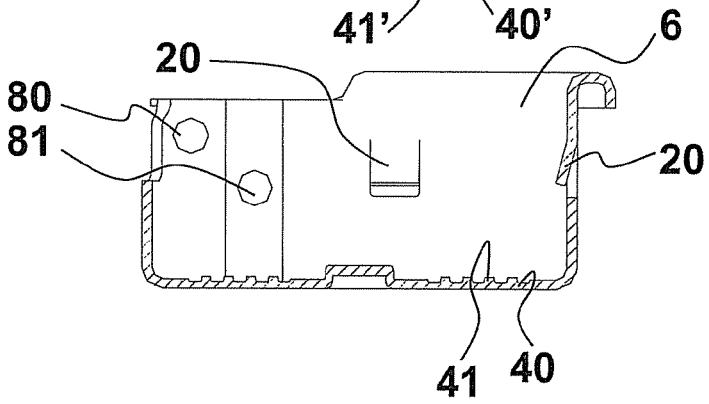

The box 6, as illustrated more clearly in FIG. 6, is provided on its base with annular concentric grooves 40 and ribs 41 which can be coupled in a complementary way with similar grooves 40' and ribs 41' provided on the lower surface of a braking disc 23 and between which there is arranged the viscous grease. This advantageously makes the device undoubtedly silent and the braking force more effective thanks to the increased extension of the coupled and friction surfaces with the viscous medium.

The braking disc 23 is provided on its upper surface with spiral grooves 30, in which a lower protuberance 29 of the slider 18 engages to convert the translation of the slider 18, transmitted to this by the cam element 16 of the rocker 3, into a rotation of the braking disc 23.

In particular, the protuberance 29 engages with at least one of the spiral grooves 30 by means of a profile which is complementary to the profile with a saw-tooth cross-section of said grooves.

In the door opening phase, as illustrated in FIG. 1, translation of the slider takes place by a lifting of the protuberance 29 which engages in a groove adjacent to the initial one, while the braking disc 23 does not move. The slider 18 is guided in translation by the edges of the opening 15 provided inside the casing 14, which encloses the slider 18 and the braking disc 23 between itself and the box 6.

On the other hand, in the closing phase of the door, the cam projection of the connection element 16 acts on corresponding projections of the slider 18 causing the translation thereof and, by means of the engagement of the protuberance 29 in the groove 30, the rotation of the braking disc 23 and thus the damping action. All the elements of the damping device are immersed in a viscous medium.

Advantageously the protuberance 29 is provided with a substantially pointed end 42, which allows a correct operation of the damping device of the hinge even in abnormal conditions, for example, when the door is not completely opened, but is immediately closed again after being moved only by a small angle from its rabbet position against the piece of furniture. In this situation the slider 18 can be in the position illustrated in FIG. 1, with the protuberance 29 resting on a crest formed by the spiral grooves 30, pushed by side projections of the cam element 16. If the door is closed again, the tip of the cam element 16 rests on the inclined surface of the pointed end 42 pushing it downwards so that it presses against the crests of the teeth formed by the grooves 30 generating a decelerated rotation of the braking disc 23 until reaching a new position of normal operation, obtaining the overall braking effect for the hinge.

Without this pointed end 42, if the door were closed again from the position in FIG. 1, the cam element 16 connected to the rocker 3, by passing from a counter-clockwise to a clockwise movement, would move the protuberance 29 of the slider 18 towards left, without this protuberance engaging with the profiles with saw tooth sections formed by the grooves 30, and therefore without obtaining the braking effect. This expedient can also be used in the second embodiment of the hinge described below.

Figure 2:
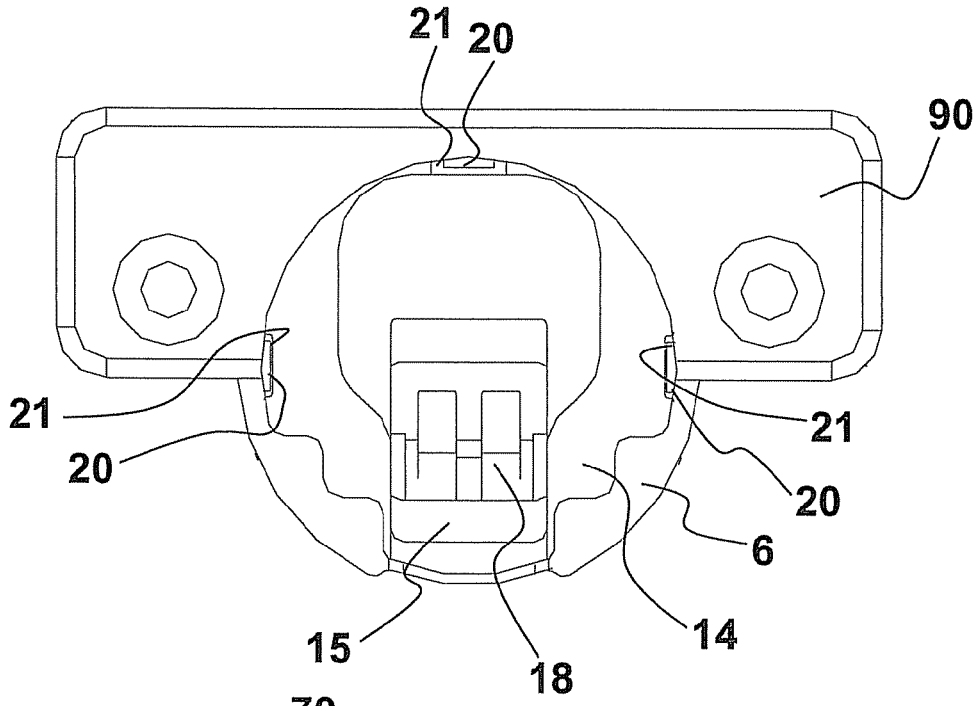
FIG. 2 shows a top view of part of the hinge in FIG. 1.
Figure 3:
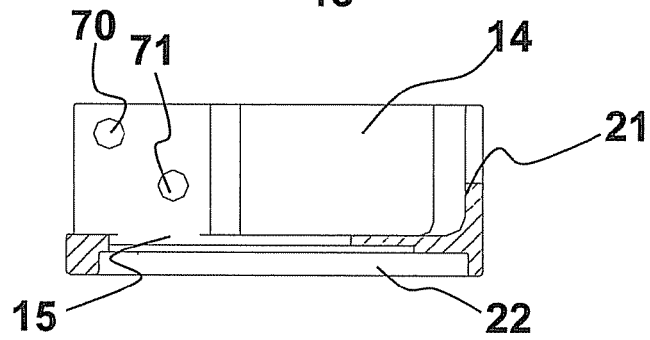
FIG. 3 shows a sectional view of a first component of the hinge in FIG. 1.
Figure 4:
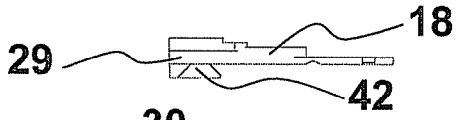
FIG. 4 shows a side view of a second component of the hinge in FIG. 1.
Figure 5:
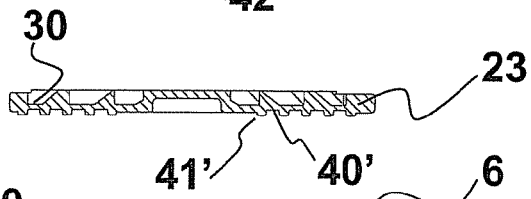
FIGS. 5 and 6 show sectional views of further two components of the hinge in FIG. 1.

The inside of the casing 14 of the hinge according to the invention is substantially the same as the inside of a standard box of a known hinge, as illustrated more clearly in FIG. 2 which shows a top view of the box 6 provided with the pre-mounted damping device. The outside surface of the casing 14 is substantially that of a cylinder, except in correspondence with the holes 70, 71 for housing the articulation pins 7, 8 of the rockers 2, 3 where there are provided flat surfaces parallel to one another and each oriented along a chord of the base circumference of said cylinder.

The drawn part of the box 6 is also provided with a side wall that is substantially cylindrical, the shape of which corresponds to the outside shape of the casing 14 so that the respective holes 80, 81 for housing the pins 7, 8 of the rockers 2, 3 are, in the mounted position, aligned with the holes 70, 71 of the casing 14.

Advantageously, in three points of its wall the box 6 is provided with tabs 20 which are cut and project inwards. Said tabs 20 are suitable to push against corresponding stop planes 21 provided on the edge of the casing 14, so as to hold it in its pre-mounted position.

Tabs 20 and stop planes 21 can, alternatively, be arranged respectively on a wall of the casing 14 and on an edge of the box 6. In this case the tabs project towards the outside.

The slider 18 and the braking disc 23 are housed inside a lower cylindrical cavity 22, provided in the lower part of the casing 14, the edges of which act as a sealing element for the viscous grease.

Figure 7:
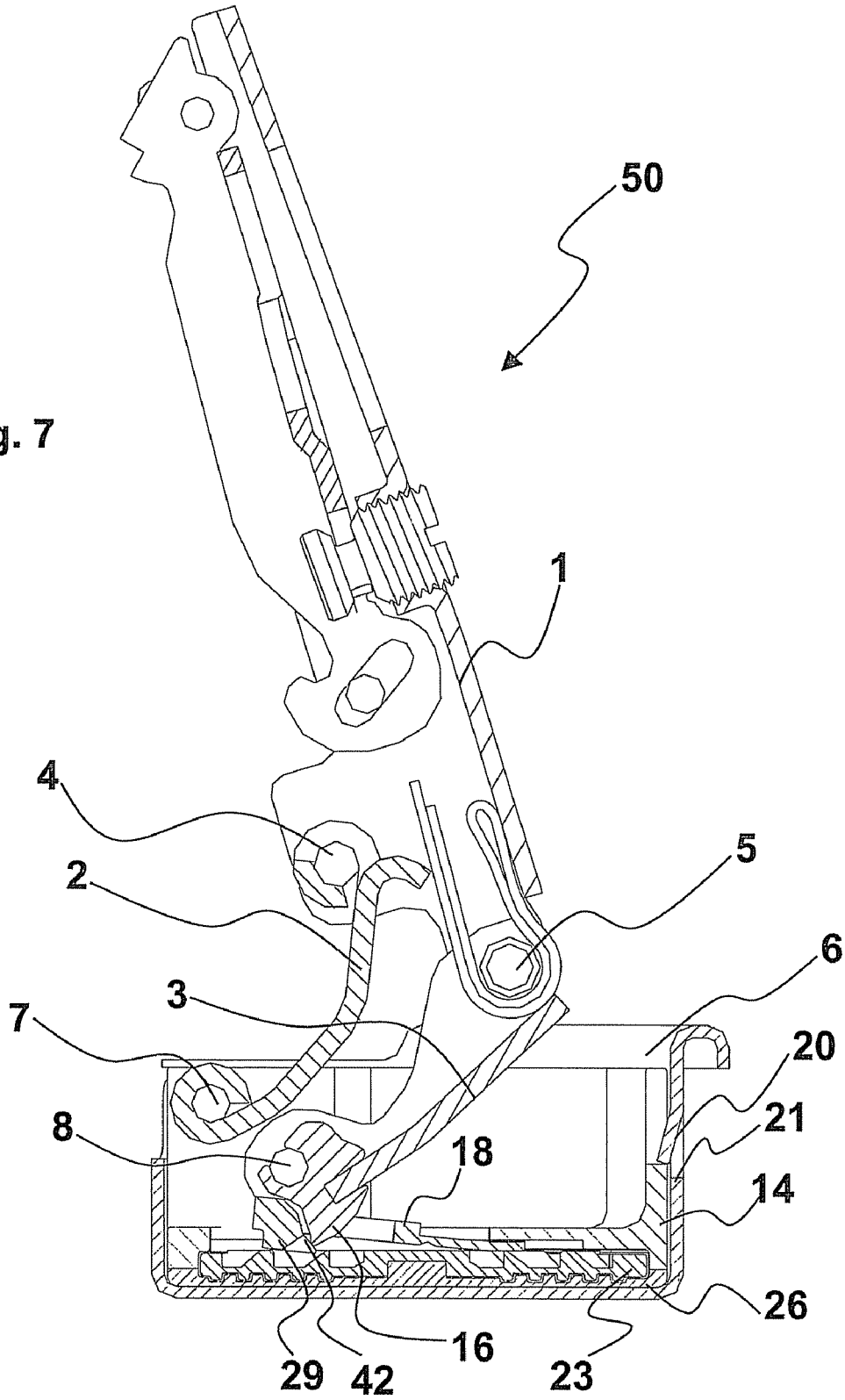
FIG. 7 shows a sectional view of a second embodiment of the hinge of the invention in a half-open position.
Figure 8:
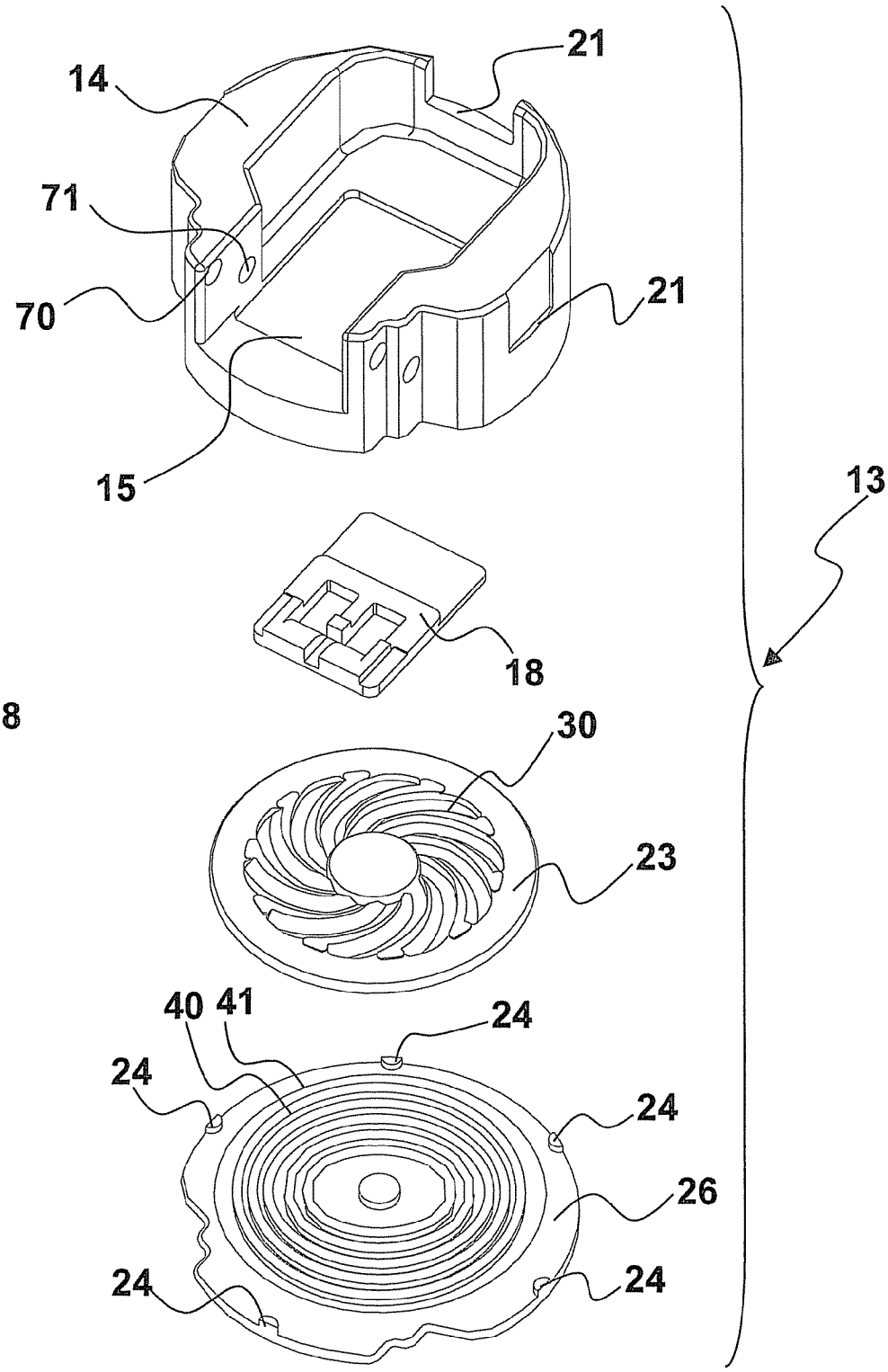
FIG. 8 shows an exploded view of part of the hinge in FIG. 7.

According to a second advantageous embodiment of the hinge of the invention, illustrated in FIGS. 7 and 8, unlike the first embodiment described above, the base of the box 6 is completely smooth and the lower cylindrical cavity 22 of the casing, which houses the slider and the braking disc, is closed by a flat element 26, or closing plate of the damping device, provided with the concentric grooves 40 and ribs 41 which can be coupled with the respective ribs 41' and grooves 40' of the lower surface of the braking disc 23. This flat element 26 allows the damping device to be fastened shut by means of appropriate peripheral projections 24 suitable to engage in seats of a complementary shape provided on the lower edge of the casing 14, or said element 26 can be fixed to the casing 14, for example, by means of ultrasonic welding.

The damping device thus assembled, comprising casing 14, slider 18, braking disc 23 and flat element 26, can then be inserted and blocked in the box 6 by means of the aforesaid tabs 20 and stop planes 21 with a single, simple and quick operation. In this case the box element therefore does not act as supporting element during mounting of the elements of the damping device. The box 6 with the pre-mounted damping device is ready to be assembled with the other components of the hinge in the usual way.

In these first two embodiments the flat part of the crests of the ribs 41, 41' and the bottom of the grooves 40, 40' can, moreover, be produced with a rough finishing to promote adhesion of the viscous medium, for example high viscosity grease, in contact therewith. Advantageously, this embodiment makes it more difficult for the grease to move in a radial direction, so that the use of gaskets between the bottom of the box element 6 and the casing 14 or between said flat element 26 and the casing is unnecessary.

Figure 9:
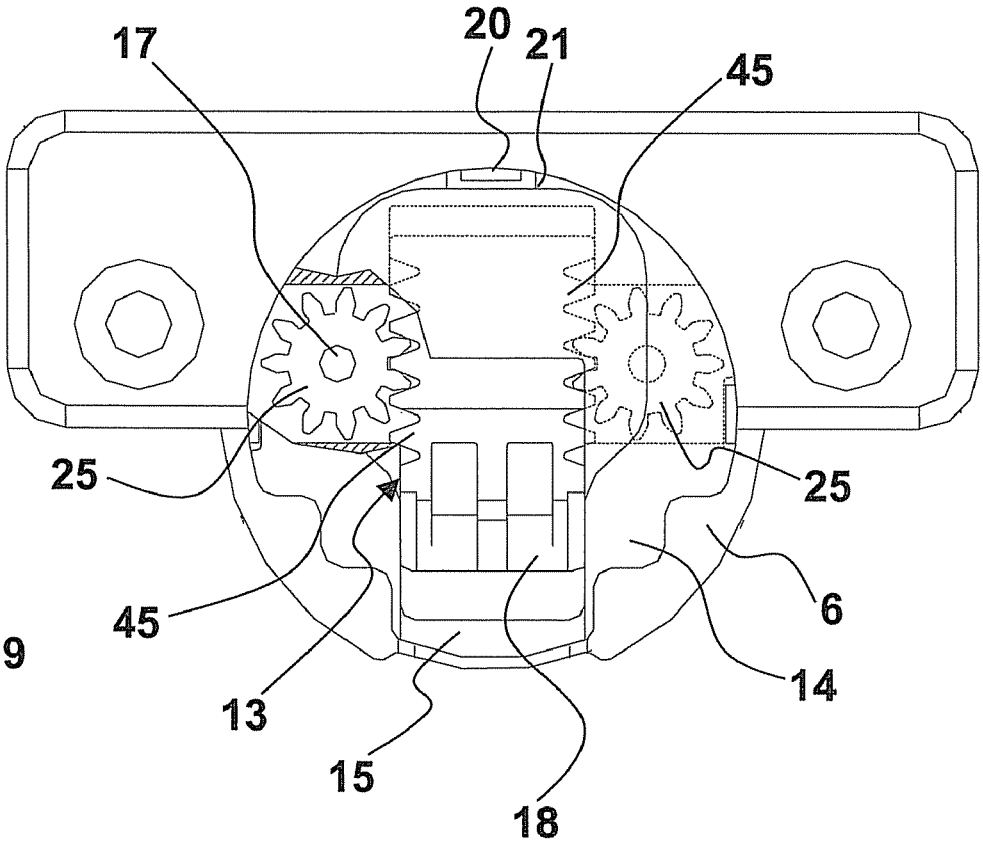
FIG. 9 shows a top view of part of a third embodiment of the hinge of the invention.

According to a third embodiment of the hinge of the invention, schematically illustrated in FIG. 9, inside the casing 14, the space comprised between the guiding side edges of the slider 18, parallel to the direction of translation of said slider, and the wall of the box 6 is used to house rotational decelerators of a known type, provided with toothed wheels 25 fitted to pins 17, perpendicular to the base of the box 6, and suitable to be made to rotate by a respective rack 45 provided along said side edges of the slider 18. Since the toothed wheels 25 are fitted to pins that are in turn provided with projecting parts (not illustrated in the figure) which rotate in an appropriate vessel and are immersed in a viscous fluid, a damping effect is generated during the rotation thereof in the door closing and/or opening phase.

Figure 10:
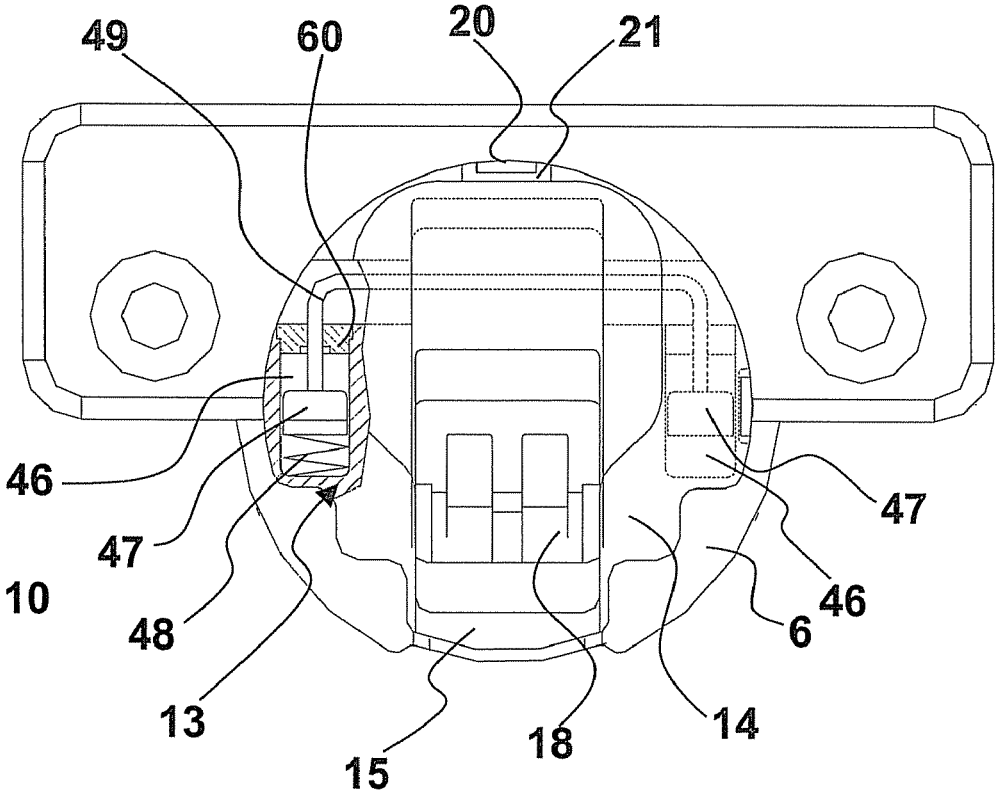
FIG. 10 shows a top view of part of a fourth embodiment of the hinge of the invention.

In a fourth embodiment of the hinge, schematically illustrated in FIG. 10, the space available between said guiding side edges of the slider 18 and the wall of the box 6 is used, instead, to obtain in both sides a cylindrical seat 46 wherein a piston 47 slides axially, possibly under the stress of a spring 48. The two pistons 47 have advantageously a common rod 49, bent in the shape of a C. Each cylindrical seat 46 is closed by a plug 60 with the relative gasket to contain a decelerating fluid, such as grease or oil.

The slider 18 is suitably connected with the C-shaped rod 49 so as to transmit to said rod its translational motion generated by the pivoting of the rocker 3 of the hinge during the door closing phase. In this case the spring 48, also known as a return spring, can be provided to ensure the return of the piston and, thus, of the slider instead of the specific return elements usually provided on the cam connection element 16.

Advantageously, using the hinge of the invention it is possible to choose to produce the damping and/or braking action in only one of the two opening and closing phases of the door or in both phases.

Optionally, the functions of the connection element 16 can be produced by means of suitably shaped tabs provided in the same sheet metal of which the rocker 3 is made.

The hinge of the invention, in all the various embodiments, also allows efficient operation without variation to the overall dimensions of standard hinges, considering the great compactness of the damping device.

The specific methods of production described herein do not limit the content of this application, which covers all the embodiments of the invention defined by the claims.

The invention claimed is:

1. Furniture hinge comprising a first member for fixing to an element of a piece of furniture, a second member for fixing to a door of said element of piece of furniture, comprising a box, said first member being suitable to move with a relative pivoting motion about at least a first articulation pin with said box, a connection element for connecting said first member to damping means for damping said pivoting motion, comprising a slider operated in translation by said connection element, at least one damping element immersed in a viscous medium suitable to be made in motion by said slider so as to produce a damping force, wherein the slider and said at least one damping element are housed between a base of the box and a substantially cylindrical cover of the damping element, said base of the box being integral and closed and said cover being fixed internally to the box and provided internally with an opening for the connection between the connection element and the slider.

2. Hinge according to claim 1, wherein a plate is arranged between the base of the box and the substantially cylindrical cover of the damping element, said plate being fixed to the lower edge of the cover so as to enclose the slider and said at least one damping element inside a cavity produced in the cover.

3. Hinge according to claim 1, wherein elastic fitting-in means are provided for a pre-assembly of said cover in said box.

4. Hinge according to claim 3, wherein said elastic fitting-in means comprise tabs suitable to push against corresponding stop planes, said tabs and said stop planes being respectively provided on walls of the box and of the cover or vice versa.

5. Hinge according to claim 4, wherein the tabs and the stop planes are provided respectively in three corresponding points of the walls of the box and of the cover.

6. Hinge according to claim 1, wherein the box is provided with at least one fixing flange for a fixing to the door of said element of piece of furniture.

7. Hinge according to claim 1, wherein said connection element is a cam element.

8. Hinge according to claim 1, wherein said at least one damping element is a disc having a substantially flat shape suitable to pivot about an axis perpendicular to the direction of said translation in order to generate a braking force in correspondence with a movement of the hinge.

9. Hinge according to claim 8, wherein there are provided kinematic means for converting motion suitable to convert the translation of the slider into a rotation of the disc about the axis, said kinematic means comprising a series of grooves on a first surface of the disc and a protuberance fixed to the slider, suitable to engage with at least one groove, having a shape so as to generate a rotation of the disc only in one direction of translation of the slider.

10. Hinge according to claim 9, wherein the grooves are spirally shaped and have profiles with saw-tooth cross-sections, and the protuberance on the slider has a profile with a cross-section having a shape that is complementary to the profiles of the grooves.

11. Hinge according to claim 10, wherein the protuberance on the slider is provided with one substantially pointed end, suitable to press against the profiles with saw-tooth cross-sections of the spiral grooves in the door closing phase starting from a partially open position of said door.

12. Hinge according to claim 9, wherein suitable annular concentric grooves and ribs are provided on a second surface of the disc engaged respectively in complementary ribs and grooves provided on the base of the box or on the plate arranged between said second surface and said base of the box.

13. Hinge according to claim 1, wherein said at least one damping element comprises toothed wheels arranged laterally in relation to the slider and engaged with respective racks produced on side edges of said slider so as to generate a rotation of said toothed wheels about a respective axis in correspondence with a translation of the slider.

14. Hinge according to claim 1, wherein said at least one damping element comprises pistons axially sliding in cylindrical seats containing a viscous medium and arranged laterally in relation to the slider, said pistons sharing a rod in common which is suitably connected to the slider so that the latter can transmit its translational motion to the pistons.

15. Hinge according to claim 1, wherein said first member comprises two elements, the first of said elements being a fixing arm for a fixing to said element of piece of furniture and the second of said elements being a first rocker suitable to pivot about the first articulation pin with said box and about a second articulation pin with said fixing arm, and there is provided a second rocker suitable to pivot about a respective first articulation pin with said box and about a respective second articulation pin with said fixing arm.

16. Hinge according to claim 15, wherein there are provided fixing means for fixing box and cover comprising the articulation pins, suitable to engage first holes of the cover and corresponding second holes of the box.

* * * * *